United States Patent [19]

Karakawa et al.

[11] Patent Number: 4,852,484

[45] Date of Patent: Aug. 1, 1989

[54] METHOD AND APPARATUS FOR PRINTING ON A TRAVELING WEB

[75] Inventors: Koichi Karakawa, Chiba; Tatsuhiko Yoshimatsu, Shisui; Hideyuki Tsuchimoto, Urawa; Katsumi Hiwatashi, Urayasu, all of Japan

[73] Assignee: Kyokuto International Corporation, Japan

[21] Appl. No.: 229,152

[22] Filed: Aug. 5, 1988

[30] Foreign Application Priority Data

Aug. 6, 1987 [JP] Japan ..... 62-195369

[51] Int. Cl.[4] ..... B41M 1/10

[52] U.S. Cl. ..... 101/170; 101/153; 101/219; 101/228

[58] Field of Search ..... 101/483, 170, 150, 151, 101/152, 153, 156, 178, 219, 228, 232, 350, 365, DIG. 11, DIG. 21

[56] References Cited

U.S. PATENT DOCUMENTS

| | | | |
|---|---|---|---|
| 3,742,849 | 7/1973 | Greiner et al. | 101/220 |
| 4,004,510 | 1/1977 | Roch | 101/232 |
| 4,437,402 | 3/1984 | Fischer | 101/228 |
| 4,438,694 | 3/1984 | Parkins et al. | 101/178 |
| 4,454,810 | 6/1984 | Katsutoshi | 101/153 |
| 4,542,693 | 9/1985 | Mourrellone | 101/350 |
| 4,592,278 | 6/1986 | Tokuno et al. | 101/228 |

*Primary Examiner*—Eugene H. Eickholt

*Attorney, Agent, or Firm*—Wenderoth, Lind & Ponack

[57] ABSTRACT

A method and apparatus for printing repeat patterns of various lengths from a printing apparatus with a limited number of printing cylinders by driving the web being printed and the rotary printing means at a predetermined speed ratio. An impression element for pressing the web against the rotary printing cylinder has an impression portion with a radius of curvature in a range of from 2 mm to 70 mm.

17 Claims, 5 Drawing Sheets

METHOD AND APPARATUS FOR PRINTING ON A TRAVELING WEB

This invention relates to method and apparatus for printing on a traveling web, and more particularly relates to method and apparatus for so-called "all size" printing.

BACKGROUND OF THE INVENTION

In a rotary-press printing on a web, some methods have been proposed which print a pattern of any size or repeat length without the necessity of exchanging plate cylinders, one example is disclosed in Japanese Pat. No. 35-7195, of June 15, 1960.

In this prior art device, the traveling speed of the web or the peripheral speed of the plate cylinder was rapidly varied while printing was not being carried out, that is to say while there was no contact between the web and the plate cylinder. However, there were some problems with this method which had to be solved. Typical problems are as follows:

(a) The web may be easily broken because the web speed is quickly increased or decreased, and this makes registering the printing patterns harder.

(b) If the plate cylinder is rotated in a rapid increment or decrement, it is necessary to use a high powered motor to rotate the plate cylinder, and this also makes it difficult to register the printed patterns.

The present inventors diligently sought to overcome the above problems, and finally found that prints of any repeat length could be made by differentiating between the web speed and the peripheral speed of the plate cylinder, which is an example of printing means. Some patent applications relating to such printing system have been already filed in the Japanese Patent Office, for example published unexamined Japanese application Nos. 62-183348 and 62-227683 of Aug. 1, 1987 and Oct. 11, 1987.

The present inventors continued working on the problems and found that the contact line between the web and the printing cylinder still had little a bit of width, although it was referred to as "line contact," and they found the width of the contact affected the quality of printing, and that the quality could be raised by making the contact line narrower.

In this specification the term "web" is understood to mean something continuous, long and thin, and includes rolled paper, rolled film, linerboard, kraft paper for bags, rolled foil etc. which can be printed on. The material of the web is not limited other than in this respect.

OBJECTS OF THE INVENTION

The present invention is based on the above described findings, and the objects of the invention are as follows:

(a) to minimize the blur or scuff caused by the difference between the web speed and the peripheral speed of the printing means, (b) to decrease the undesirable effect caused by the impression means; and (c) to print an endless pattern and a pattern of predetermined repeat length in a corrugated paperboard line.

BRIEF SUMMARY OF INVENTION

To this end the present invention provides an improved method for printing on a traveling web comprising the steps of controlling the tension of said web so that the web is not a loose web, differentiating between the traveling speed of said web and the peripheral speed of printing means in a predetermined ratio, and bringing said web into contact with said printing means while using impression means the radius of curvature of which is selected to be in the range between 2 millimeters and 70 millimeters. The invention also provides an apparatus for printing on a traveling web comprising speed-controlling means which differentiates between the traveling speed of said web and the peripheral speed of printing means in a predetermined ratio, impression means having an impressing portion the radius of curvature of which is selected to be in the range between 2 millimeters and 70 millimeters, and means for bringing said web into contact with said impression means.

Other objects and advantages of the invention will become apparent from the following description taken in connection with the accompanying drawings.

DETAILED DESCRIPTION OF INVENTION

The invention will be described referring to the embodiments shown in the accompanying drawings. It is to be expressly understood, however, that the drawings are only for the purpose of illustration and are not intended as a definition of the limits of the invention.

Figure 1:
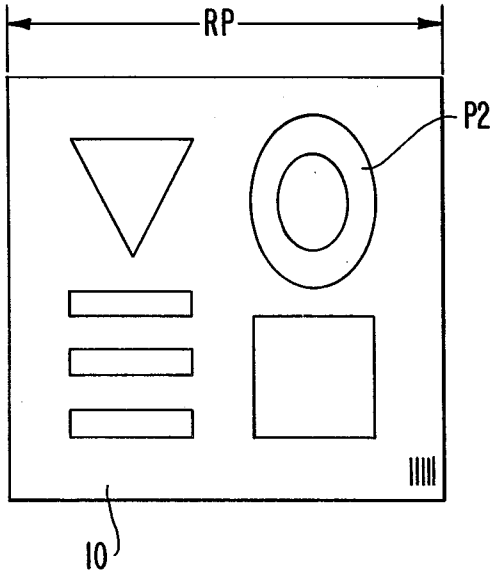
FIG. 1 is a developed view of a printing plate used in the method and apparatus of the present invention.

FIG. 1 is a developed view of a printing plate 10 usable the present invention. The plate 10 is one example of printing means. The plate 10 can be a flexographic plate or a photosensitive plate for letterpress printing, a PS (pre-sensitized) plate for lithography, a photogravure sheet mountable on a plate cylinder, etc. Sometimes no plate is mounted on a cylinder, for example, when an engraved cylinder is used for printing and the engraved cylinder plays the role of printing means. Similarly a blanket cylinder can be the printing means for offset printing. In this specification plate 10 is typically described as printing means; however, it is not intended that the printing means be limited to such a plate.

The plate 10 is an example of a printing means the image or patters of which is elongated during printing, that is the actual repeat length "R" is longer than the length "RP" of the plate 10 in the printing direction.

Figure 2:
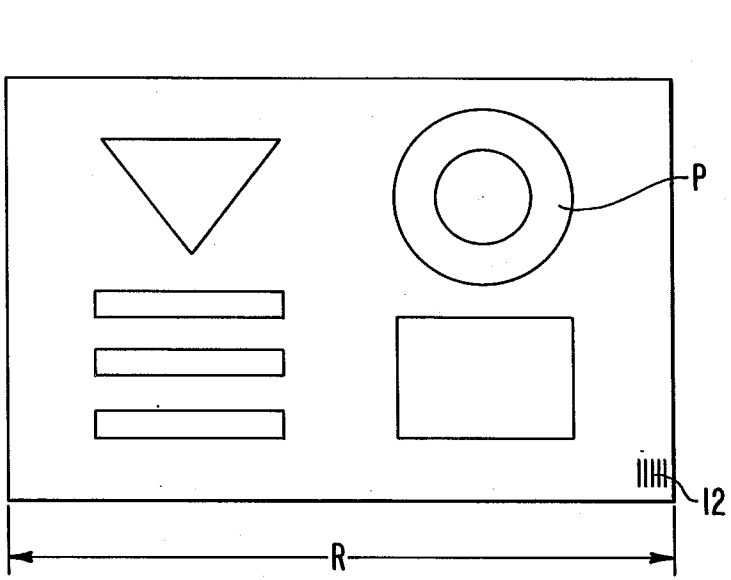
FIG. 2 is a plan view of a sheet printed by the method and apparatus of the present invention.

A printed pattern P such as illustrated in FIG. 2 can be produced by using the plate 10 with 50% elongation. Therefore the pattern P2 on said plate 10 is reduced compared to the actual printed pattern P.

Needless to say, the printing portion does not always cover the whole repeat length, and any length within the repeat length can be arbitrarily chosen. Register marks can be printed the same as in the ordinary way.

Although not illustrated, a reduced length pattern can be printed by relatively reducing the traveling speed of said web compared to the peripheral speed of said plate 10. In such case the length, in the rotating direction, of the pattern on the plate 10 is longer than that of the actual printed pattern. An apparatus which elongates or reduces the pattern in the rotating direction of said plate cylinder or in the traveling direction of said web will be described in connection with FIG. 3.

Some ways of printing with elongation or reduction in length are;

(a) to vary the peripheral speed or the rotating angle of plate cylinder 50 uniformly in a predetermined ratio according to the traveling speed or the distance of movement of web 20, (b) to regulate the traveling speed of said web 20 or the peripheral speed of said plate cylinder 50 while measuring the length of printed pattern, (c) to control the traveling speed of said web 20 at a predetermined ratio to the peripheral speed of said plate cylinder 50.

Many other methods may be used. However, the present invention requires at least that the predetermined ratio, the ratio of the traveling speed of said web 20 to the peripheral speed of said plate cylinder 50, should be kept substantially constant.

Figure 3:
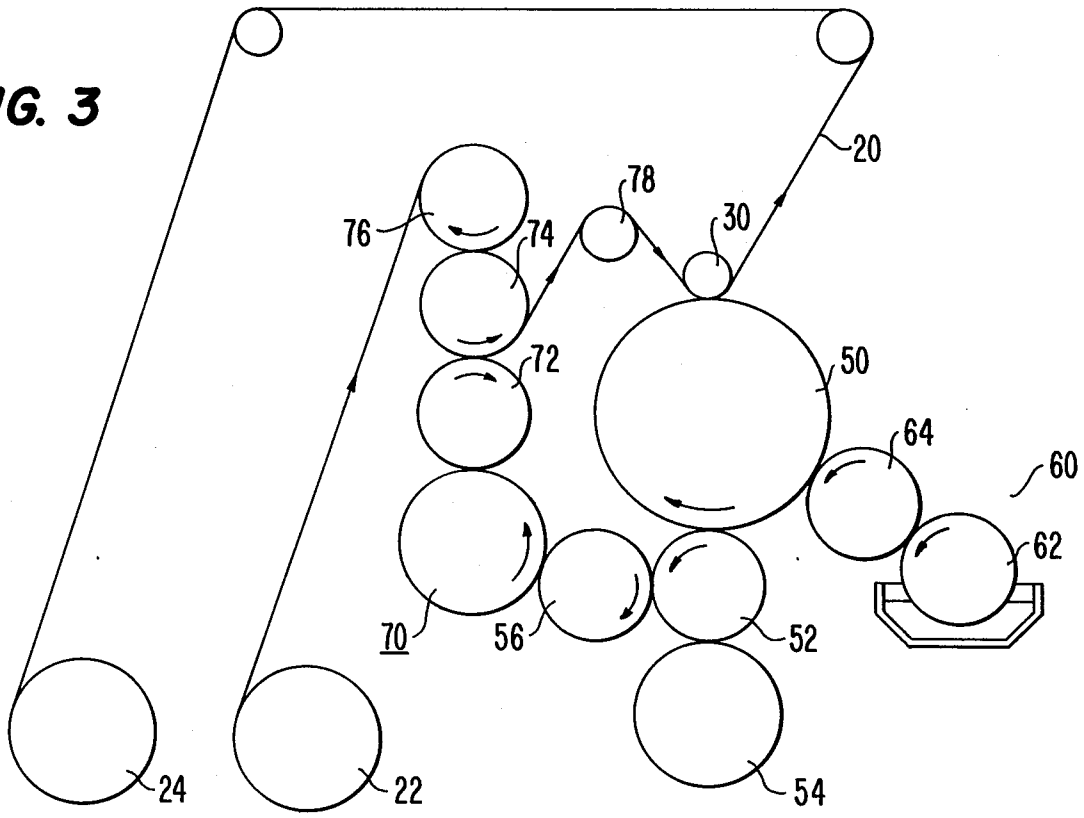
FIG. 3 is a schematic side elevation of an apparatus according to the invention.

It depends on the type of printing, such as in-line printing or off-line printing, which of the methods described above is used. In the apparatus of FIG. 3, the traveling speed of web 20 is controlled according to the peripheral speed of said plate cylinder 50.

The plate 10 is mounted on the plate cylinder 50, and a proper amount of ink is supplied onto said plate 10. For elongated printing, a proper amount of ink will be supplied to the plate 10 proportionally to the elongating ratio. When reduced printing is carried out, the amount of ink supply is substantially proportional to the reducing ratio.

With a roll-coating type inking device 60 as shown in FIG. 3, inking can be carried out by regulating the clearance between a fountain roll 62 and an inking roll 64 or changing the rotating ratio between said rolls 62 and 64.

Said plate cylinder 50 is driven by motor 54 through a first gear 52. The gear on said plate cylinder 50 is not shown the drawings, because the diameter of the gear is the same size as that of said plate cylinder 50. The driving force of said first gear 52 is also transmitted through a second gear 56 to a transmission 70, which is an example of a speed-controlling means. A desired speed ratio is provided by the transmission 70, and a ratio setting device (not shown) is mounted thereon so that the traveling speed of said web 20 can be changed according to a preset ratio. The details of the means for setting the ratio and the setting device, are not shown in the drawings because they are conventional. One adequate transmission is a transmission sold under the trademark FINEDRIVE obtainable from Shinpo Industries Co. of Kyoto, Japan.

Although a mechanical transmission 70 is shown in FIG. 3, needless to say an electronic or electric speed-controlling means such as a numerically controlled motor, can be used as said speed controlling means. One such electronic speed controlling means is sold under the trademark DDS-SR by Reliance Electric Limited of Yokohama, Japan.

Output from said transmission 70 is delivered through a third gear 72 to web-driving roll 74. Nip roll 76 is brought into contact with said web-driving roll 74 for holding said web 20 therebetween. Therefore the traveling speed of said web 20 drawn from unwinder 22 is controlled at a predetermined ratio to the peripheral speed of said plate cylinder.

Tension of said web 20 is controlled in order to avoid a loose web. For example a dancer roller or a motor for rewinding are used for tension control. If the web 20 is loose, it will be difficult to print with an accurate repeat length. Thus it is very important to control the tension.

The web 20 corrugated a speed controlled at a predetermined ratio to the speed of the plate cylinder 50 is drawn by rewinder 24 and is brought into contact with said plate cylinder 50 after passing over guide roll 78. In a conventional press, an impression cylinder is used for pressing the web against the plate cylinder. In this invention, impression means 30 is used for the same purpose, but said impression means 30 is not always a cylinder.

When a rotatable roll is chosen as the impressing portion of said impression means 30, the diameter thereof is preferably between 10 millimeters and 140 millimeters, and it is more preferable to select the diameter from the range between 20 millimeters and 100 millimeters. It is most preferable to choose it in the range from 20 millimeters to 50 millimeters. More details will be described hereinafter in an example. Though the sizes of said roll are given in terms of the diameter, it should be noted that the value of the radius of curvature thereof is equal to half the value of the diameter.

It is difficult to manufacture a roll the diameter of which is less than 10 millimeters, and in practice it is hard to support such a roll rotatably. For preventing it from bending, the larger in diameter the roll is, the stronger it is. On the contrary, the print quality becomes worse if the diameter is larger than 200 millimeters. The limit is around 140 millimeters.

When the speed ratio is set at 1.13 or 0.89, a diameter of about 50 millimeters gives the same print quality as that of conventional sheet-fed flexographic printing for corrugated board. The quality is judged based on the marginal zones. Unlike the general definition, in this specification "marginal zone" means light, pale or faint portion of the prints. A diameter of about 30 millimeters gives the same quality as that of uniform speed printing is using the same roll.

The ratios 1.13 and 0.89 are typical of maximum and minimum values to cover any repeat length. In practice, it is necessary to use three sizes of plate cylinders 50, large, medium and small to cover this range. The maximum repeat length is limited to 1.13 times when using the large cylinder. In other words if the ratio of the speed of the plate cylinder 50 to the speed of the web 20 is changed in the range between 0.89 and 1.13, it can produce any repeat length up to the maximum one. For the middle of the range, the medium size cylinder is used and for the low end of the range the small cylinder is used.

The ratio may vary in the range from 0.89 to 1.19 in which case two cylinders can be used. The respective ones of four cylinders can be used to cover the range of ratios from 0.91 to 1.09. If five cylinders are available, the range of ratios can be from 0.93 to 1.07. No differences can be seen when using more than six cylinders in terms of print quality. Two to five cylinders gives enough quality in flexographic printing, and three cylinders provide sufficient print quality if high resolution printing such as process color is not required.

One cylinder usually cannot cover all repeat lengths satisfactorily. An experiment using a plate cylinder of 100 millimeters in diameter and a ratio of 1.42 times produced the same marginal zones as conventional sheet-fed flexographic printing on corrugated boards. As is evident from the example set forth later, the smaller the ratio, the narrower the marginal zone, and one cylinder gives feasible quality within a limited range of ratios.

Figure 4:
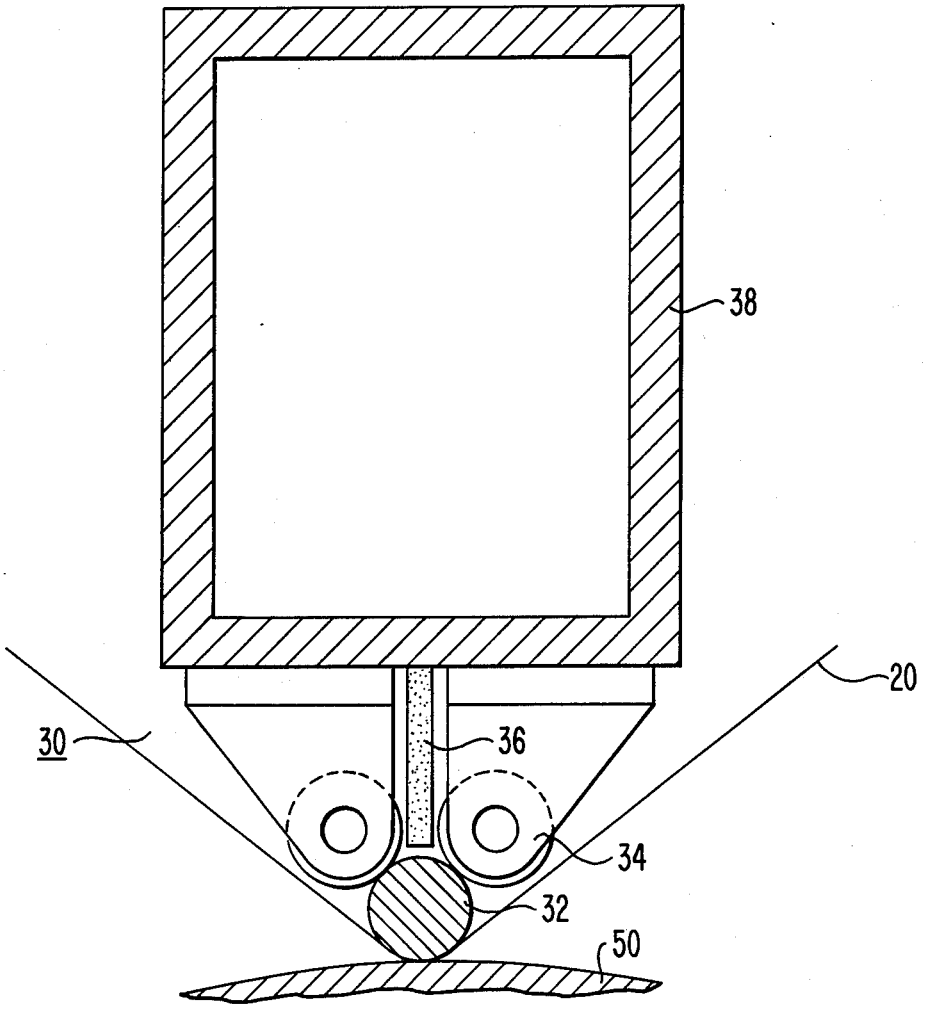
FIG. 4 is a sectional side elevation, on an enlarged scale, of impression means for use in the apparatus according to the invention.

FIG. 4 is a sectional view of impression means. The impressing portion is constituted by a rotatable roll 32. As the roll 32 is relatively small in diameter, preferably with a 10 to 25 millimeters radius of curvature, the roll 32 tends to be bent.

In such a case, printing a web meters wide causes a mal-impression, so that back-up means 34 are provided in order to produce an equal impression across the entire width. Said back-up means can be, for example, rollers or ball bearings. The pitch of the back-up means depends on the diameter of said roll 32, and preferably they are spaced 20 to 30 centimeters from each other along the roll 32. As said roll 32 hangs downward, the roll 32 bends downwards, and it is preferable to pull it upwards by means of magnet 36. Needless to say, the magnet 36 can be either permanent or electric.

In order to increase the mechanical accuracy of said impressing portion the strength of frame 38 should be increased.

Figure 5:
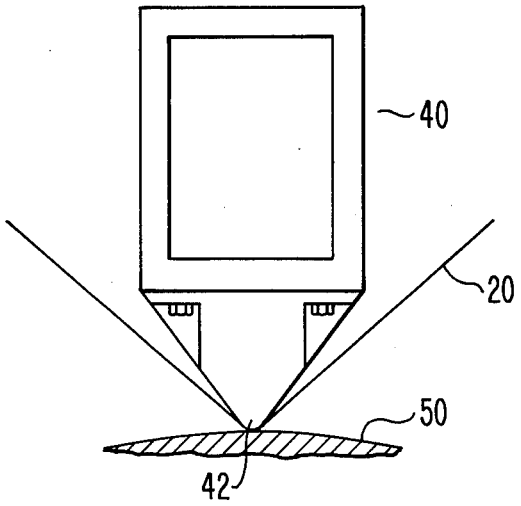
FIG. 5 is a view similar to FIG. 4, showing another impression means.

Unlike the roll 32, a non-rotatable impressing portion 42 as shown in FIG. 5 can provide a much smaller radius of curvature, because said impression means can itself be larger. If said web 20 is pressed against the plate cylinder 50 with said impressing portion at an angle to the radius through the contact point, too small radius of curvature often breaks the web 20 or it causes wrinkles, cracks, or warps. For example, it is almost impossible to choose a radius of curvature less than 5 millimeters for an impressing means for use in printing a linerboard of 220 (g/square meter) in place of a continuous web 20. A web of flexible and thin plastic film can be pressed by an impression means with a radius of curvature down to about 2 millimeters.

If a roll is unrotatably fixed, it can act as if it were impression means as shown in FIG. 5. Furthermore, if said impressing portions 32 and 42 is a roll is covered with ceramic material or is treated by quenching, the abrasion thereof by the material of the web is reduced and it becomes more durable. A ceramic coating, usually varies from 50 to 300 microns(micro-meters) in thickness. Instead of a ceramic coating, said impressing portion can itself be made partially or totally of ceramic. It should be noted that the impressing portion should be a low friction material to have better durability against abrasion, and also should be finishable in an accurate size.

There are several methods for coating ceramic materials. Plasma coating is a convenient one and provides sufficient durability of the coating. Suitable ceramics should be durable with respect of abrasion, such as aluminas, titanias, zirconias and cermets. Above all alumina-titanias and tungsten-carbides are preferable.

After passing said impressing means as described above the printed web 20 is rolled into rewinder 24 as usual, and the printing process comes to an end.

In FIG. 3, a one-color press is shown. However, the present invention is not limited to a one-color printing. It is also applicable to a multicolor printing press.

Figure 6:
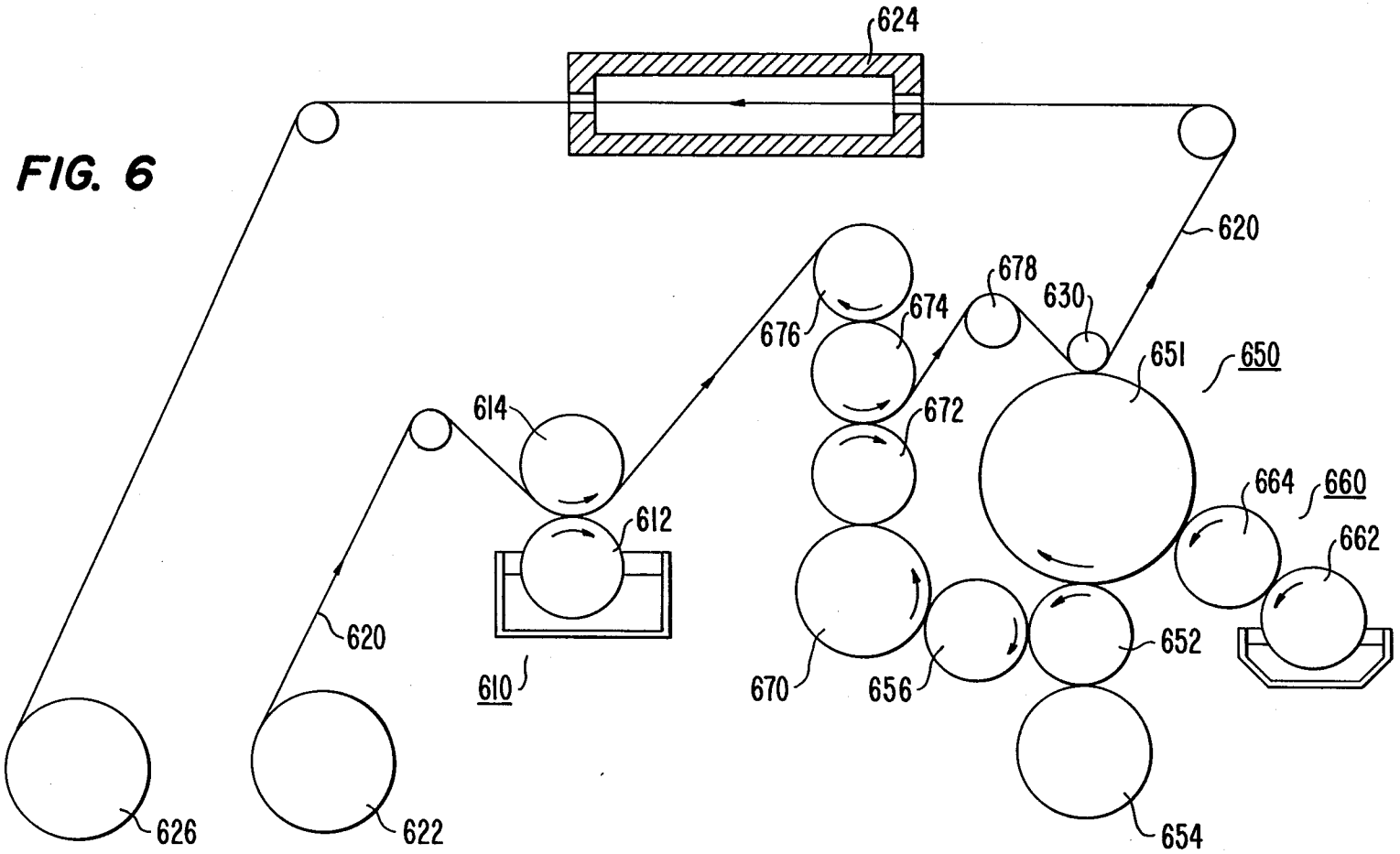
FIGS. 6 and 7 are schematic views of other embodiments of the apparatus according to the invention.

FIG. 6 is a side elevation, and shows an embodiment of printing apparatus which prints an endless pattern and a pattern of predetermined repeat length on a linerboard in the same line. The linerboard 620 is drawn from unwinder 622 and comes first to intaglio rotary printing unit 610 where an endless pattern is printed on the linerboard. Then a pattern of predetermined repeat length is printed on said endless pattern by the remainder of the printing unit which will be described later.

Gravure cylinder 612 has an outer diameter of about 20 to 30 centimeters, and patterns are etched thereon by a photogravure process. Said cylinder 612 is a kind of intaglio printing means. The cylinder may be engraved by machine or laser, etc. Said gravure cylinder does not have any driving device, and is frictionally engaged and rotated by said linerboard 620. Thus the peripheral speed of said gravure cylinder is substantially the same as the traveling speed of linerboard 620. Impression cylinder 614 is also driven by said linerboard 620. A doctor blade (not shown) may be applied to said gravure cylinder 612. When a doctor blade is not used, the engraved portion to be printed has a somewhat shaded or thick color and other portions have a tinted or light color, and this looks like as if it were a two-color print. No doctor blade is used when printing equally the whole surface of the linerboard, and the print looks like a colored linerboard manufactured in a papermill.

After the whole surface of the linerboard 620 is printed, said linerboard 620 reaches the second printing unit 650. Unlike conventional presses, the embodiment in FIG. 6 shows a press the peripheral speed of the printing means 651 of which differs from the traveling speed of linerboard 620.

The traveling speed of said linerboard 620 is controlled by nip rolls 674 and 676 before the linerboard 620 reaches said second printing unit 650. The ink applied to the linerboard 620 by the gravure cylinder 612 substantially sets within 1 to 5 seconds, so that distance of travel of the linerboard 620 for drying is only about 3 meters at a speed of 100 meters a minute.

Said nip rolls 674 and 676 are driven by motor 654. The motor 654 drives printing means 651 through gear 652, and also drives transmission 670 through gears 652 and 656. The output speed of the transmission means is increased or decreased by a predetermined ratio and rotates said nip roll 674 through gear 672.

The reason for differentiating between the peripheral speed of printing means 651 and that of nip roll 674, which is the same as the traveling speed of linerboard 620, is to be able to print a pattern of arbitrary repeat-length. By this technique, a pattern of any size can be printed without exchanging printing cylinders. Printing means 651 can be a plate such as used in flexographic printing, a gravure cylinder such as used in rotogravure printing, or a blanket cylinder such as can be used in offset printing, and shall be understood to mean a device for printing linerboard 620 directly. For printing on a linerboard, flexographic printing is preferable to offset printing in terms of surface smoothness, and also preferable to rotogravure printing from the view point of the cost of making plates or printing means.

A pattern of a predetermined repeat length is printed on a linerboard 620 which has passed over guide roll 678 to second printing unit 650. The traveling speed of linerboard 620 is faster than the peripheral speed of printing means 651 when the repeat length is longer than the circumferential length of printing means 651. The amount of ink to be applied to proportionally increased to the ratio of said traveling speed to said peripheral speed.

In FIG. 6, the amount of ink is regulated by adjusting the nip between fountain roll 662 and inking roll 664. The pattern on printing means 651 is reduced in inverse proportion to the speed ratio, so that the pattern is printed in a regular size. When the repeat length is shorter than the circumferential length, inking is regulated in the opposite way.

Upon completion of printing, the web is rolled onto rewinder 626 after passing through drier 624.

When the peripheral speed of printing means 651 is differentiated from the traveling speed of linerboard 620, the method and the apparatus are similar to the apparatus described above, so that a detailed description thereof will be omitted in this specification.

Figure 7:
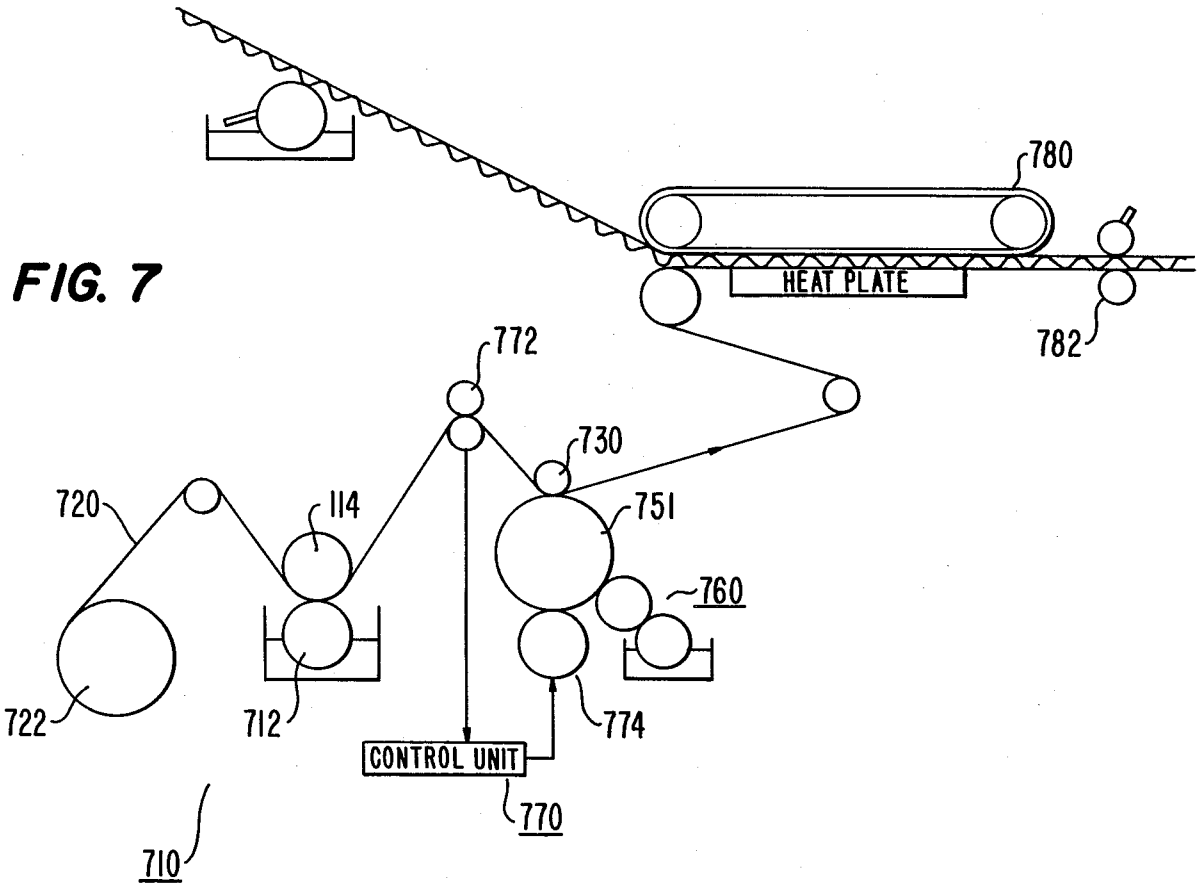

FIG. 7 is a side elevation which shows an embodiment for printing an endless pattern and a pattern of a certain repeat length on linerboard which is then applied as one face of corrugated board. Intaglio rotary printing unit 710 has gravure cylinder 712 and impression cylinder 714. The printing unit 710 has the same structure and movement as said printing unit 610 in FIG. 6, so that a detailed description is omitted.

Linerboard 720 printed with as an endless pattern on the whole surface thereof, has the traveling speed or the distance traveled measured by travel sensor 772. The travel signal produced by the senor 772 as a result is transmitted to control unit 770 which is an example of speed-controlling means.

A signal corresponding to the ratio of the traveling speed of the linerboard 720 to the peripheral speed of printing means 751, i.e. the speed ratio, a signal corresponding to the effective circumferential length of the pattern, and a signal corresponding to the reducing ratio of motor 774 are transmitted to or preset in control unit 770. Said control unit 770 calculates the control signals for motor 774 in order to get the desired speed ratio, and controls the motor 774 accordingly.

The structure and movement of inking device 760 are the same as for inking device 660, and a detailed description is omitted. Upon completion of printing the linerboard 720 reaches the double facer 780, and is applied to form a double-faced corrugated board. Upon detecting the register marks, rotary cutter 782 cuts the corrugated board into sheets.

EXAMPLE

In an apparatus as shown in FIG. 3, printing was done on the basis of the radius of curvature of the impression means. The main conditions thereof were as follows:

Printing Speed: 100 meters a minute
Diameter of plate cylinder 50: 260 millimeters
Plate: Photosensitive plate for flexography
Thickness; 7 millimeters
Manufacturer; Asahi Chemical Industry Co. Ltd.
Trademark; APR The plate is reduced or elongated according to the speed ratio of the plate cylinder and the web.

Width of lines to be printed: 0.4 millimeters
Direction of the lines: Parallel to the axis of said plate cylinder
Web: Linerboard, so-called K-liner, 220 g/square meter
Ink: Flexographic ink for linerboard
Speed ratio: 1.13 for elongation, 0.89 for reduction The printed samples were evaluated as to the "marginal zone" and the total width of said lines. Measuring was done by a magnifying glass with a scale.

The "marginal zone" appeared in the center of the line in an equal speed printing, at the rear edge relative to the traveling direction, of the line in elongated printing, and at the front edge of the line in reduced printing. The results are shown in the following table.

TABLE

| stand ratio radius of curvature (mm) | 1.00 (equal speed) | | 1.13 (elongation) | | 0.89 (reduction) | |
|---|---|---|---|---|---|---|
| | A*1 | B*2 | A | B | A | B |
| 100 | 0.2 | 0.4 | 0.5 | 0.9 | 0.4 | 0.7 |
| 70 | 0.2 | 0.4 | 0.3 | 0.8 | 0.3 | 0.7 |
| 50 | 0.2 | 0.4 | 0.3 | 0.8 | 0.3 | 0.7 |
| 25 | 0.2 | 0.4 | 0.2 | 0.6 | 0.2 | 0.6 |
| 15 | 0.15 | 0.4 | 0.15 | 0.5 | 0.15 | 0.4 |
| 10 | 0.15 | 0.4 | 0.15 | 0.4 | 0.15 | 0.4 |

*1 A means the width of "marginal zone" out of the line.
*2 B means the total width of the line.

The results shown in principle that the smaller the radius of curvature of the impression means, the better the print quality. When a linerboard is used as a web it is not recommended to chose a radius of curvature less than 10 millimeters. As the linerboard is usually thicker than other webs it causes inner stresses or warps by bending thereof. Thus it is not preferable to choose less than 10 millimeters as the radius of curvature.

Print qualities for elongation and reduction become the same as that of equal speed printing when the radius of curvature of the impression means is about 15 millimeters. A radius of less than 10 millimeters does not give better print quality anymore. The reason is not yet clear but it is supposed to be cause by the flexography itself.

The ratios in the table are for three cylinder printing that covers any repeat length. It may be possible to provide three cylinders on a turret which exchanges the cylinders easily and lessens the exchanging time.

EFFECT OF THE INVENTION (a) As described above, the present invention makes it possible to print any size without exchanging plate cylinders, because of the difference between the traveling speed of the web and the peripheral speed of the printing means and because of the small radius of curvature of the impressing means.

(b) Only two through five printing means can provide sufficient quality of prints, and this lowers the cost of manufacturing a large number of cylinders.

(c) Fewer plate cylinders require less storage and less management. More particularly, if a turret type cylinder holder with the two or four cylinders is used, no storage space for additional cylinders is needed.

(d) Neither the web nor the plate cylinder used have the speed thereof rapidly decreased or increased which makes registering easier. This lessens the probability of a broken web, and reduces the power needed in the driving motor.

(e) A hardened impression portion increases the durability of the impression means.

(f) The simple structure makes it possible to provide an apparatus according to the invention in line with a corrugated board apparatus, and also to print a pattern of certain repeat length on an endless pattern.

We claim:

1. A method for printing on a traveling web, comprising the steps of:

controlling the tension of said web for preventing it from becoming loose;

passing the web over a rotating printing means;

driving the web at a traveling speed which is at a predetermined ratio to the peripheral speed of the printing means; and pressing said web into contact with said printing means by an impression means having a radius of curvature in a range between 2 mm and 70 mm.

2. The method as claimed in claim 1 in which said radius of curvature is between 2 mm and 25 mm.

3. The method as claimed in claim 1 in which said radius of curvature is between 5 mm and 25 mm.

4. The method as claimed in any one of claims 1, 2 or 3 in which the printing means is one of a plurality of plate cylinders selected from among two to five plate cylinders.

5. The method as claimed in any one of claims 1, 2 or 3 further comprising the step of regulating the amount of ink supplied to said printing means according to said speed ratio.

6. An apparatus for printing on a traveling web, comprising:

a rotating printing means having a peripheral surface;

web feeding means for feeding a web into contact with a point on the peripheral surface of said printing means;

speed control means connected with said web feeding means and said rotating printing means for controlling the traveling speed of said web and the speed of rotating of said printing means for causing the value of the ratio of the traveling speed of said web and the peripheral speed of said printing means to be at a predetermined ratio; and impression means having an impressing portion with a radius of curvature in a range of from 2 mm to 70 mm, said impression portion being opposed to the peripheral surface of said printing means for pressing said web against said peripheral surface.

7. An apparatus as claimed in claim 6 in which the radius of curvature is in a range of from 2 mm to 25 mm.

8. An apparatus as claimed in claim 6 in which said impression means is a roll.

9. An apparatus as claimed in claim 8 further comprising backup means supporting said roll against bending.

10. An apparatus as claimed in claim 9 in which said backup means is a magnet.

11. An apparatus as claimed in any one of claims 13–15 in which the radius of curvature is from 5 mm to 25 mm.

12. An apparatus as claimed in claim 11 in which the surface of said roll is a hardened surface.

13. An apparatus as claimed in claim 11 in which said roll is a ceramic roll.

14. An apparatus as claimed in any one of claims 8–10 in which said roll is a ceramic roll.

15. An apparatus as claimed in any one of claims 8–10 in which the surface of said roll is a hardened surface.

16. An apparatus as claimed in claim 6 or 7 in which the surface of said impression portion is a hardened surface.

17. An apparatus as claimed in claim 6 or 7 in which said impression portion is made of a ceramic.

* * * * *